United States Patent [19]

Simuro et al.

[11] 4,187,607

[45] Feb. 12, 1980

[54] HORSEMAN'S POCKET KNIFE

[76] Inventors: Ernest G. Simuro, 624 Fenimore Rd., Mamaroneck, N.Y. 10543; Abraham A. Turk; Nathan M. Turk, both of Rocking Horse Ranch, Highland, N.Y. 12528

[21] Appl. No.: 899,336

[22] Filed: Apr. 24, 1978

[51] Int. Cl.[2] ..... F41B 63/06; B26B 3/04

[52] U.S. Cl. ..... 30/152; 168/48 R; 30/155; 7/118

[58] Field of Search ..... 168/45, 48; 30/155, 30/156, 157, 158, 159, 160, 161, 123, 152

[56] References Cited

U.S. PATENT DOCUMENTS

| | | | |
|---|---|---|---|
| 97,154 | 11/1869 | Barnard et al. | 30/152 |
| 237,138 | 2/1881 | Slayton | 30/152 |
| 436,659 | 9/1890 | Harris | 30/152 |
| 516,671 | 3/1894 | Wedekind | 168/48 |
| 541,793 | 6/1895 | Schenck | 30/123 |
| 544,540 | 8/1895 | Jones | 30/155 |
| 567,493 | 9/1896 | MeCartea | 168/48 |
| 682,938 | 9/1901 | Ingram | 168/48 |
| 1,015,026 | 1/1912 | Jackson et al. | 30/152 |
| 1,265,532 | 5/1918 | Scott | 30/152 |

*Primary Examiner*—Robert L. Spruill
*Assistant Examiner*—W. D. Bray
*Attorney, Agent, or Firm*—Brumbaugh, Graves, Donohue & Raymond

[57] ABSTRACT

A horseman's pocket knife has a handle into which a plurality of useful blades can be folded. The knife includes a hoof-cutting blade with a cutting edge along one side. A hook-shaped cross section is established at the end of the hoof-cutting blade and its tip is also provided with a cutting edge. The width of the hoof-cutting blade toward the hooked end and the size of the hook are dimensioned so that the cutting blade can be folded into the handle without interferring with the handle or other blades. A hoof-cleaning blade in the shape of a hook in the plane of the blade may also be provided for removing stones and other debris from the horse's hoof.

6 Claims, 5 Drawing Figures

HORSEMAN'S POCKET KNIFE

BACKGROUND OF THE INVENTION

This invention relates to pocket knives and, more particularly, to pocket knives especially designed for use with horses.

It has long been known that special knives can be very useful when working with horses. Such knives are used by blacksmiths in preparing the horse's hoofs for shoeing, by veterinary surgeons in operating on the horse's hoofs and by ranch hands who care for horses and their associated leather equipment. One of these knives, i.e. a hoof-cutting knife, must be capable of trimming the edges of the hoof and planing the bottom of the hoof. The blade used for planing the bottom of the hoof may typically have a hook-shaped cross section so that it may be pulled across the hoof to remove layer of callous. Also, one knife may be used to cut leather straps and another to punch holes in leather. A pick-type cleaning knife is useful in removing stones and dirt from the horse's hoof. Naturally it would be very inconvenient to have to carry a number of these knives, especially when travelling about the countryside on horseback. As a result, multi-bladed horseman's knives have been developed.

Typical multi-bladed knives designed for use with horses are described in U.S. Pat. No. 544,540 to Jones and U.S. Pat. No. 541,793 to Schenck. These knives have a number of blades attached to a handle, but the blades are so designed that they cannot fit within a convenient size handle. Hence the knife is bulky and difficult to carry in the user's pocket. In addition neither knife has a hoof-cutting blade with a hook-shaped cross section useful in planing the bottom of the horse's hoof. Some of these problems are solved by the knife described in U.S. Pat. No. 567,493 to McCartea which has a small handle in which its various blades can be stored. The McCartea knife also has a hoof-cutting blade with a hook-shaped cross section. The end of this hook-shaped blade, however, is designed as a mud scraper and not as a planing blade. Because of the hook shape this blade also cannot be stored within the small handle.

It would be extremely useful to the person working with horses, e.g. the horseman, the blacksmith, etc., if a knife could be developed with a blade for planing the horse's hoof which would fit within a small handle so as to form a pocket knife.

SUMMARY OF THE INVENTION

The present invention is directed to the creation of a horseman's pocket knife with a hoof-cutting blade designed so that it may fit within the handle of a pocket knife.

In an illustrative embodiment, a horseman's knife is formed with a handle the size of a typical pocket knife. This knife may have several useful conventional blades such as a broad knife for cutting leather, an awl for punching holes in leather and a pick for removing objects caught in a horse's hoof. These blades are pivotally connected to the handle and can be stored within a recess in the handle. This knife also includes a hoof-cutting blade with a cutting edge along one side and a hook-shaped cross section at the end remote from its pivotal attachment to the handle. At the very end of the hook shape there is a lateral cutting edge useful in planing the bottom of a horse's hoof. The arc of the hook shape and the width of the blade in that region are shaped so that it may also be stored within the recess in the handle without interferring with the other blades. In particular the hook-shaped end may wrap around another blade and the width may be such that the blade rests on a pivot post for another blade without extending substantially beyond the recess in the handle.

Other embodiments of the horseman's pocket knife include a hole through the awl so that it may be used somewhat in the fashion of a needle to thread leather tongs through other pieces of leather. Also, one of the other blades can be replaced with a metal mane comb which fits within the recess of the handle. By enlarging the handle slightly, the mane comb can be used in addition to the other blades instead of being a substitute for one of them.

BRIEF DESCRIPTION OF THE DRAWINGS

The foregoing and other features of the present invention will be more readily apparent from the following detailed description and drawings of and illustrative embodiment of the invention in which.

DESCRIPTION OF EXEMPLARY EMBODIMENTS

Figure 1:
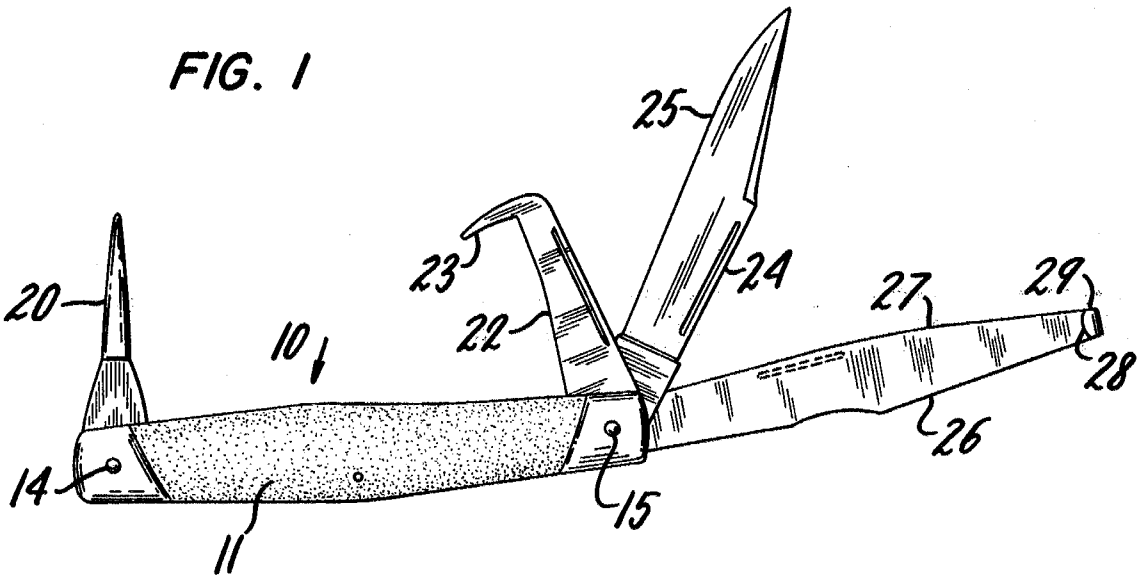
FIG. 1 is a side view of a horseman's pocket knife according to the present invention.
Figure 2:
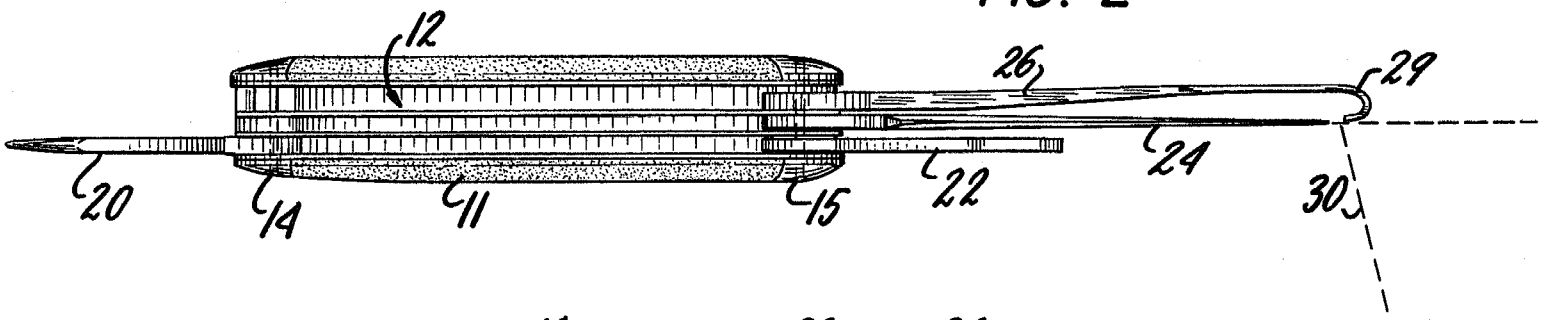
FIG. 2 is a top view of the knife of FIG. 1 in an open position.
Figure 3:
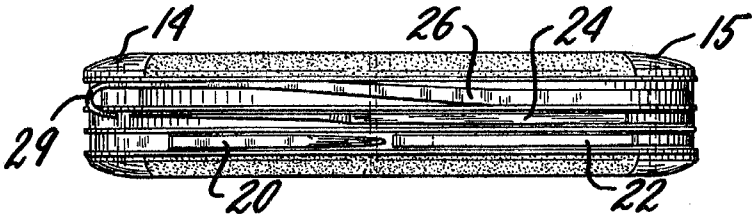
FIG. 3 is a top view of the knife of FIG. 1 in a closed position.
Figure 5:
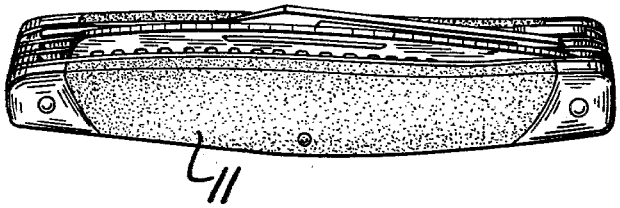
FIG. 5 is a perspective view of the knife of FIG. 4 in the closed position.

In FIGS. 1-3 there is shown a unique horseman's pocket knife 10, having a handle 11 of approximately the same size and construction as the typical pocket knife, but having blades adapted for use with horses. The handle has a recessed area 12 into which the blades may be folded by rotating them about pivot axes 14 and 15. The blades and the recess are so dimensioned that when the blades are pivoted into the recess the cutting or punching edges are concealed and they form a small package with the handle suitable for carrying in one's pants pocket (FIG. 5).

Pivoted to axis 14 is an awl 20 which can be used to punch holes in leather. On pivot axis 15 there are three blades 22, 24 and 26. However, any one of these blades could be moved to pivot 14. In addition other blades can be added or substituted for all of the blades shown, except for blade 26, and still come within the teaching of the present invention. The blade 22 has a hooked pick-shaped end 23 that is curved in the plane of the blade. This blade 22 is useful for removing stones, dirt and other debris from the horse's hoof and is especially handy for doing this while riding at a distance from the stables. Blade 24 is a broad blade suitable for cutting leather, wood, etc. by means of a cutting edge along lateral edge 25 of the blade. When in the closed position the edge 25 is well within the recess 12 and, hence the knife can be inserted in one's pocket without fear of injury.

For cutting the callous that forms on the bottom of the horse's hoof, the blade 26 is provided. It has a lateral cutting edge 27 which may be used like blade 24, but is designed specifically for trimming the edge of the hoof. At a hook-shaped end 29 of the blade 26, there is a cutting edge 28 useful in planing the callous from the bottom of the horse's hoof. The hook shape of this blade, as best seen in FIG. 2 is perpendicular to the plane of the blade. By pulling the blade 26 across a hoof 30 (shown in dotted line in FIG. 2) layers of callous can be peeled from the hoof in a controlled fashion, thus preventing injury to the tender flesh of the horse under the callous. When this planing operation is being performed naturally blades 22 and 24 are retracted into the recess 12.

With prior art knives, the perpendicular curve (i.e. hook-shaped cross section 29) of the hoof-cutting knife was larger and made it impossible to pivot the knife into the recess 12 of the handle. However, with the present invention the size of the arc has been changed so that it easily fits within the recess. Also, if one of the blades, such as pick 22, is moved to pivot 14, the size of the arc to blade 26 is such that it will pass around that blade and still fit within the recess. In FIG. 3 the hook 29 of this blade is shown passing around the end of broad blade 24. FIG. 1 shows that the width of the blade 26 is reduced towards the hook-shaped end 29. This allows the blade 26 to rest on top of pivot 14, if necessary, without extending substantially out of the recess 12.

Figure 4:
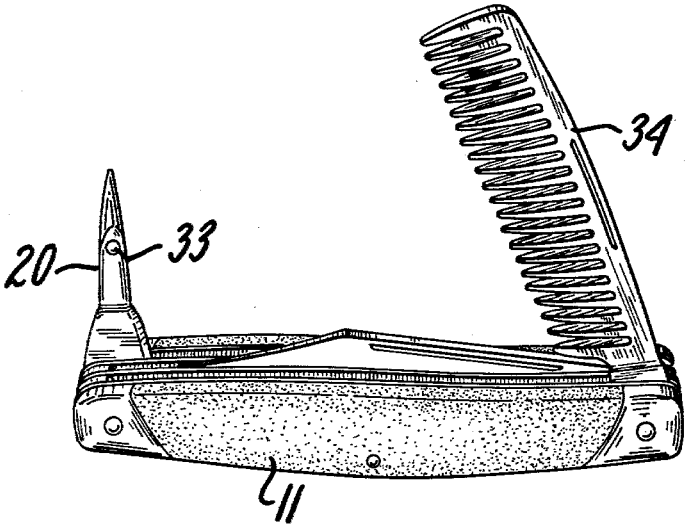
FIG. 4 is a perspective view of the knife of FIG. 1 further including a mane comb.

A mane comb 34 has been added to the pocket knife in the embodiment of FIG. 4. This comb serves the usual purpose of combing burrs, dirt, etc. from the horse's mane. Also, in this embodiment the awl 20 has been provided with a hole 33 through it which can be used to thread leather tongs through sheets of leathers, thereby sewing them together. As can be seen from FIG. 5, when the blades, awl and comb are pivoted into the recess in the handle, a compact package is formed in which all of the dangerous edges are concealed. Consequently this knife can easily be carried in the pants pocket of the user.

While the invention has been particularly shown and described with reference to preferred embodiments thereof, it will be understood by those skilled in the art that various changes in form and details may be made therein without departing from the spirit and scope of the invention.

We claim:

1. A horseman's pocket knife of a size that will conveniently fit in a pants pocket, said knife having a handle with a recess of a predetermined depth and a plurality of blades pivoted about pivot pins located toward each end of the handle between closed positions in which the blades are positioned in the recess in the handle for storage and operative positions in which they are pivoted out from the handle recess for use, wherein the improvement comprises: one of said blades being a hoof-cutting blade for planing the bottom of a horse's hoof and shaping the hoof, said hoof-cutting blade having a lateral cutting edge along one lateral edge of the blade, said hoof-cutting blade being pivotally connected to the handle at one of said pivot pins so that it can be folded into the handle in such a way that the lateral cutting edge is concealed in the handle, said hoof-cutting blade additionally having its free end being of a hook shape in a plane perpendicular to the plane of the lateral width of the blade, said hook-shaped end having a transverse cutting edge transverse to the longitudinal dimension of the blade, the lateral width of the cutting blade decreasing toward said hook-shaped free end so its width at the transverse cutting edge is at least substantially as small as the depth of the recess in the handle so that the transverse cutting edge is substantially concealed in the recess when in the closed position and the hook shape having an arc such that the hoof-cutting blade fits within the handle without interfering with any other blade by extending about such a blade.

2. A horseman's pocket knife as claimed in claim 1 wherein another one of the blades has a hook shape in the plane of the blade so as to form a pick for removing debris from a horse's hoof.

3. A horseman's pocket knife as claimed in claim 1 wherein another one of the blades in an awl for punching holes in leather.

4. A horseman's pocket knife as claimed in claim 3 wherein the awl blade has a hole in it for use in threading leather tongs through sheets of leather.

5. A horseman's pocket knife as claimed in claim 1 wherein one of the blades is a broad knife for cutting leather.

6. A horseman's pocket knife as claimed in claim 1 further including a mane comb pivotally mounted on the handle and being retractable into the recess in the handle.

* * * * *

UNITED STATES PATENT AND TRADEMARK OFFICE

CERTIFICATE OF CORRECTION

PATENT NO. : 4,187,607

DATED : February 12, 1980

INVENTOR(S) : Simuro et al.

It is certified that error appears in the above-identified patent and that said Letters Patent are hereby corrected as shown below:

Column 1, line 19, "layer" should read -- layers --;

Column 2, line 21, "and" (second occurrence) should read -- an --;

Column 4, line 33, "in" should read -- is --.

Signed and Sealed this

*Seventeenth* Day of *June 1980*

[SEAL]

*Attest:*

SIDNEY A. DIAMOND

*Attesting Officer*

*Commissioner of Patents and Trademarks*